United States Patent [19]

Davis et al.

[11] Patent Number: 4,899,197

[45] Date of Patent: Feb. 6, 1990

[54] FUSER FOR USE IN AN ELECTROPHOTOGRAPHIC PRINT ENGINE

[75] Inventors: David R. Davis, Buford; Danny L. Slayton, Lilburn; Raymond J. Shook, Lawrenceville, all of Ga.

[73] Assignee: Colorocs Corporation, Norcross, Ga.

[21] Appl. No.: 194,756

[22] Filed: May 17, 1988

[51] Int. Cl.[4] ..... G03G 15/20

[52] U.S. Cl. ..... 355/290; 355/282; 355/283; 355/285; 355/289

[58] Field of Search ..... 355/277, 279, 281, 282, 355/284, 299, 274, 275, 285, 295, 289, 290, 283; 430/44, 99, 136; 118/101, 115; 427/194

[56] References Cited

U.S. PATENT DOCUMENTS

| | | | |
|---|---|---|---|
| 3,820,985 | 6/1980 | Gaynor et al. | 355/217 X |
| 3,861,860 | 1/1975 | Thettu et al. | 355/283 |
| 3,966,394 | 6/1976 | Braun | 355/283 |
| 4,000,957 | 1/1977 | Ruhland | 355/284 |
| 4,147,501 | 4/1979 | Goshima et al. | 355/282 |
| 4,195,927 | 4/1980 | Fotland et al. | 355/277 |
| 4,230,783 | 10/1980 | Aoki et al. | 430/32 |
| 4,231,653 | 11/1980 | Nagahara et al. | 355/283 |
| 4,423,951 | 1/1984 | Rightmyre | 355/274 |
| 4,533,231 | 8/1985 | Shigenobu | 355/284 |
| 4,541,707 | 9/1985 | Yoshinaga | 355/283 |
| 4,652,110 | 3/1987 | Sato et al. | 355/282 |

FOREIGN PATENT DOCUMENTS

| | | |
|---|---|---|
| 25234 | 6/1982 | Japan . |
| 6067980 | 4/1985 | Japan . |

*Primary Examiner*—A. C. Prescott
*Assistant Examiner*—T. Finn
*Attorney, Agent, or Firm*—Jones, Askew & Lunsford

[57] ABSTRACT

An improved fuser for use in an electrophotographic print engine having mutually compressible rollers for uniformity and thoroughly fused toner images. Also, the need for paper fingers to guide image receptor sheets is eliminated. The wear on the fixing device in the improved fuser is reduced by preventing binding of oil leveling blades, removing offset toner, and the use of oiling rollers in conjunction with oil leveling blades to apply oil to the fixing device. An improved fuser is also easily accessible and serviceable. The fusing device is contained within a clam-shell housing such that the fixing device and the compression device are separated when the housing opens thereby freeing jammed image receptor sheets and allowing convenient access for further service and repair. In addition, an oil wick, an oil tank, and the leveling blade comprise a subassembly which can be removed and replaced.

12 Claims, 7 Drawing Sheets

FUSER FOR USE IN AN ELECTROPHOTOGRAPHIC PRINT ENGINE

TECHNICAL FIELD

The present invention relates to a fuser apparatus for use in an electrophotographic print engine. More particularly, the present invention relates to an improved fuser which is easily accessible for service and repair, incurs less wear during operation, and produces multicolor images with improved clarity and glossy finish.

BACKGROUND OF THE INVENTION

Electrophotography refers to producing photographic images by electrical means, and xerography is a form of electrophotography for copying documents and other graphic matter. Xerographic copiers are extensively used in a variety of environments, such as offices, libraries, and educational institutions.

The basic elements of a xerographic copier are well known to those skilled in the art. A light source forms an electrostatic latent image of an original document on a photosensitive medium. The photosensitive medium, as it moves within the copier, travels adjacent to a source of tiny plastic particles called toner. The electrostatic force of the latent image on the photosensitive medium attracts the toner, thereby providing a developed image of toner particles on the surface of the photosensitive medium. The toner image is transferred through electrostatic charges to an image receptor, which is normally a sheet of paper or plastic. The image receptor then passes through a fuser which heats and melts the toner particles, thereby fixing or fusing the image of the original onto the image receptor.

Prior art fusers generally comprise a pair of rollers between which the image receptor passes. One roller, usually the bottom roller, is not as compressible as the other such that a nip is formed in the center of the contact length of the two rollers. The image receptor, while passing through the nip, traverses the arc of the less compliant roller. One or both of the rollers is heated so as to melt the toner particles. The two rollers compress the image receptor as it passes between the rollers, thereby fixing or fusing the melted toner particles to the image receptor. Oil is applied to the roller which makes direct contact with the plastic toner particles, so as to prevent the melted toner particles from adhering to the roller. In some prior art fusers, the fuser oil is applied to a third roller called an oiling roller which in turn applies the fuser oil to the fixing roller. The oiling roller is used to provide a more uniform thickness of fuser oil on the fixing roller.

The fuser oil is normally applied to the fuser with a wick. A portion of the wick is immersed in an oil reservoir from which the oil moves by capillary attraction through the wick to the oiling roller. In other prior art fusers, a wick applies the fuser oil directly to the fuser. A leveling blade contacting the oiled roller is often used to provide a more uniform thickness of fuser oil on the fixing roller.

In color xerographic copiers, to form a complete color image the photosensitive medium must form a separate image for each color of toner used (usually primary colors) and transfer these separate images, one at a time, to a second medium, where the different colors are superimposed one upon the other. This second medium is called a transfer medium. After the complete color image is formed on the transfer medium, the complete color image is transferred through electrostatic changes to the image receptor. The image receptor is then passed through a fuser.

Varying combinations of the individual color toner components are often necessary to obtain a multi-color image with accurate color tones. The superimposed toner images often produce stacks of toner having a varying number of toner layers on the surface of an image receptor. Consequently, the stacks of toner have varying thicknesses. The image receptor, usually paper or plastic, also does not have a regular surface, either. Paper, particularly, has much thickness variation due to its fibrous content. The stacks of toner and the composition of the image receptor produce a toner-laden image receptor having an uneven surface shaped with peaks and valleys. All of the layers of toner must be melted and fused to obtain accurate color tones. Because the surface of the toner-laden image receptor is irregular, prior art fusers tend to contact only the peaks of toner on the image receptor. Accordingly, the peaks of toner are melted and fused to the image receptor while the valleys of toner are not melted and fused. The fused toner then has a glossy finish while the unfused toner has a dull finish. As a result, the final multi-color toner image has a non-uniform finish. In addition, the thinner stacks of toner layers are not melted and mixed and thus the final colors of those thinner stacks are not accurate.

Non-fused toner is a particularly critical problem when the image receptor is a transparency. If the toner image on the transparency is not completely fused, light cannot pass through the areas of non-fused toner. The areas of non-fused toner are thus projected as black images.

The problems caused by the irregular surface of the toner-laden image receptor sheet are magnified during two-side or duplex printing where toner images are produced on both sides of the image receptor sheet. The number of peaks and valleys are roughly doubled because the stacks of toner layers are on both sides of the image receptor sheet.

A further problem with the prior art fusers is the tendency of the image receptor to curl around one of the rollers as the image receptor passes from between the rollers. This requires that a "paper finger" be set up adjacent the roller to pull the image receptor off the roller and guide the image receptor out of the fuser. The "page fingers" must contact the rollers in order to pluck the image receptor from the roller to which it is attracted. This contact with the roller causes undue wear and, eventually, uneven roller surfaces Another problem with the prior art fusers is the difficulty involved in repairing or servicing the fuser. Prior art fusers are fixed within the print engine and are not easily accessible. This problem is particularly annoying when the image receptor, usually paper, jams in the fuser. These jams and other repairs to the fuser are usually beyond the servicing ability of the end consumer. Fuser servicing is done by a "key operator" who must come to the site of the print engine to effect repairs or requires the print engine to be brought to a service center. This results in down time when the print engine cannot be used for the purpose for which it was purchased.

Still another problem with the prior art fusers is the difficulty of the replacement of the oil application means. Prior art oil wicks, tanks and rollers have to be replaced often. These oil wicks and rollers are coated in oil. When removed, the prior art wicks, rollers and oil tanks tend to spill oil inside the machine. Accordingly, replacement of the oil wicks, tanks and rollers is often difficult and sloppy.

Another problem with prior art fusers is an uneven fixing roller surface caused by wear on the outer sleeve of the fixing roller. It is difficult to apply an even oil film to a fixing roller having an irregular surface. Also, a fixing roller with an irregular surface tends to apply an uneven layer of oil to the image receptor as the image receptor passes between the fixing roller and the pressure roller. Further, a fixing roller having an irregular surface does not apply uniform pressure to the image receptor as the image receptor passes between the fixing roller and the pressure roller. Accordingly, a fixing roller having an irregular surface does not uniformly fuse the toner image to the image receptor sheet and often causes non-fused streaks in the final toner image.

Leveling blades in prior art fusers tend to catch and bind against the fixing roller as the fixing roller passes by the leveling blade. The binding leveling blade can inflict considerable damage upon the outer surface of the fixing roller leading to an uneven surface of the fixing roller. Leveling blades are most likely to bind against the fixing roller when there is an inadequate amount of oil on the outer surface of the fixing roller.

Toner which accumulates on the outer surface of the fixing roller can also damage the outer surface of the fixing roller. As the fixing roller fuses toner-laden image receptor sheets, particles of toner are often "offset" from the image receptor sheet onto the outer surface of the fixing roller. This offset toner tends to accumulate on the outer surface of the fixing roller adjacent the leveling blades, oil wicks, or oil rollers. The accumulated toner causes the most damage when the fixing roller has cooled while the fuser is not operating, thereby hardening the accumulated toner on the outer sleeve of the fixing roller. When the fuser first resumes operation, the hardened toner can be forced under an oil wick, an oiling roller, a leveling blade, or between the fixing roller and the compression roller and damage the outer surface of the fixing roller.

The problems associated with offset toner are more severe in a color print engine. The upper layers of toner on the image receptor sheet are not held to the image receptor sheet with as much electrostatic force as the lower layers of toner. As a result, the upper layers of toner are more likely to offset from the image receptor sheet and adhere to the outer surface of the fixing roller.

In general, oil wicks tend to wear unevenly and also tend to accumulate a film of offset toner along the line of contact between the oil wick and the fixing roller. The offset toner which accumulates on the oil wick tends to block the flow of oil from the oil wick to the outer surface of the fixing roller, thereby causing the oil wick to apply an uneven oil film to the fixing roller.

Therefore, there is a need for a fuser for use in an electrophotographic print engine wherein multi-color toner images are uniformly fused. There is also a need for a fuser wherein the image receptor does not curl around one of the rollers as the image receptor passes from between the rollers. There is also a need for a fuser that is easily accessible for repair and wick replacement. There is also a need for a fuser wherein the wear on the fixing roller is reduced.

SUMMARY OF THE INVENTION

Generally, the present invention includes a fixing device and a compression device contacting the fixing device. The fixing device is moved so as to draw an image receptor sheet bearing toner between the fixing device and the compression device. The fixing device is heated so as to fuse toner to the image receptor sheet as the image receptor sheet is drawn between the fixing device and the compression device. The outer surface of the fixing device and the outer surface of the compression device are substantially mutually compressible. Because of the mutual compressibility, the image receptor is not compressed into an arc by a more rigid outer surface and forced to curl around either the fixing device or compression device; instead, the image receptor exits from between the fixing and compression devices in a substantially straight manner. This aspect of the present invention eliminates the need for paper fingers to remove the image receptor from the outer surface of the fixing or compression device. Another advantage of the mutual compressibility is that the outer surface of the fixing member and the outer surface of the compression member conform to contours of the toner-laden image receptor sheet thereby providing a substantially uniform and thorough fusing of the toner to the image receptor sheet. This aspect of the present invention provides for a toner image with more accurate color tones and a uniformly glossy finish. More specifically, the outer surface of the fixing device and the outer surface of the compression device each comprise a material having a durometer hardness of between 40 and 70. Still more specifically, the outer surface of the fixing device and the outer surface of the compression device each comprise silicon rubber.

More particularly, the present invention includes a device for storing oil for application to the fixing device, a device for applying oil to the fuser apparatus, and a device for removing excess oil from the fuser apparatus so as to level the oil film on the fuser apparatus. The devices for applying oil to the fuser apparatus, removing excess oil from the fuser apparatus, and storing the oil comprise a subassembly mounted in the fuser housing. The subassembly is then convenient and simple to remove and replace.

Even more particularly, the oil leveling device of the present invention comprises a blade and tangentially contacts the outer surface of the fixing device, thereby reducing wear on the outer surface of the fixing member by the blade.

More particularly, the present invention includes a leveling blade which contacts the outer surface of an oiling device so as to give the oil film on the oiling device a substantially uniform thickness before the oiling member transfers the oil film to the fixing device. This gives the oil film on the fixing device an even more uniform thickness.

Still more particularly, the present invention includes a first device for cleaning toner from the fixing device so the toner does not accumulate on the fixing device and damage the outer surface of the fixing device. Also, a second device cleans toner from the first cleaning device. More specifically, the present invention includes a third device for cleaning oil from the first cleaning device so as to provide a substantially oil-free first cleaning device, thereby enhancing the ability of the first cleaning device to attract toner. Even more specifically, the present invention includes a fourth device for cleaning toner from the second cleaning device.

Still more particularly, the fixing device and the compression device are mounted in a two-frame housing which can be opened and closed. The fixing device is housed in one frame and the compression device is housed in the other frame so that the outer surfaces of the fixing device and the compression device are in contact when the housing is closed and apart when the housing is opened. This aspect of the present invention allows access to the inside of the fusing apparatus for service and repair, and in particular to remove jammed image receptor sheets.

Therefore, an object of the present invention is to provide an improved fuser for use in an electrophotographic print engine.

Another object of the present invention is to provide a fuser wherein the fused toner image has a more uniform and glossy finish.

Another object of the present invention is to provide a fuser wherein the fused color toner image has improved clarity.

Another object of the present invention is to provide a fuser which is easily accessible for service and repair.

Another object of the present invention is to provide a fuser wherein the fixing device undergoes less wear.

A further object of the present invention is to provide a fuser that does not require paper fingers.

Other objects, features, and advantages will become apparent from reading the following specifications in conjunction with the accompanying drawings.

DETAILED DESCRIPTION OF THE PREFERRED EMBODIMENTS

Figure 1:
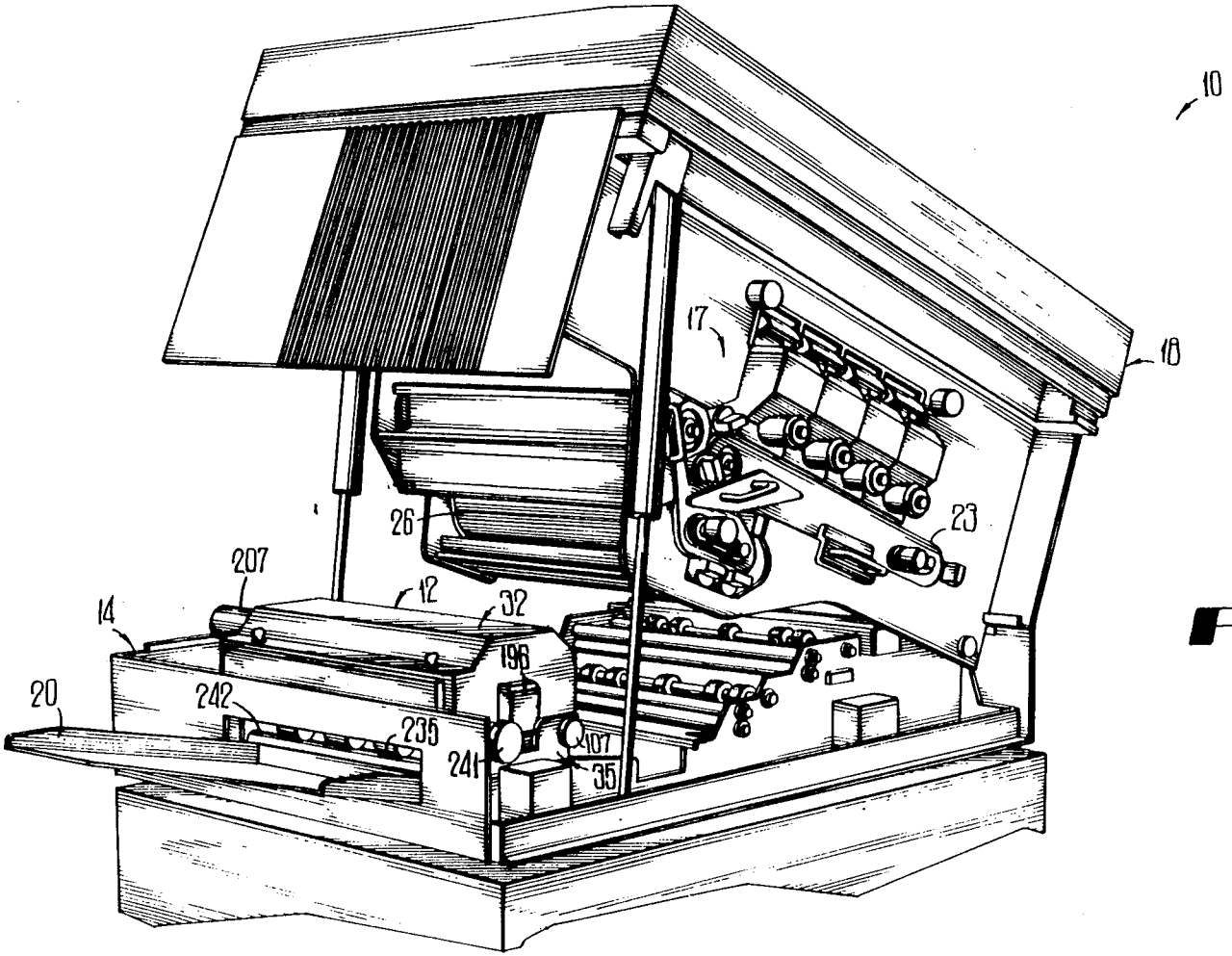
FIG. 1 is a perspective view of an open print engine according to a preferred embodiment of the present invention.

Turning first to FIG. 1, it can be seen that the print engine 10 includes a fuser apparatus 12 mounted to the lower frame 14 of the print engine and positioned between the electrostatic imaging section 17 in the upper frame section 18 of the print engine and the image receptor outlet tray 20. The print engine 10 shown in FIG. 1 is capable of producing images with multiple colors and thus the electrostatic imaging section 17 includes a photoreceptor belt 23 and a transfer belt 26. However, it should be understood that the fuser apparatus 12 of the present invention is not limited to use in a multi-color print engine but can also be used in monocolor print engines.

Figure 2:
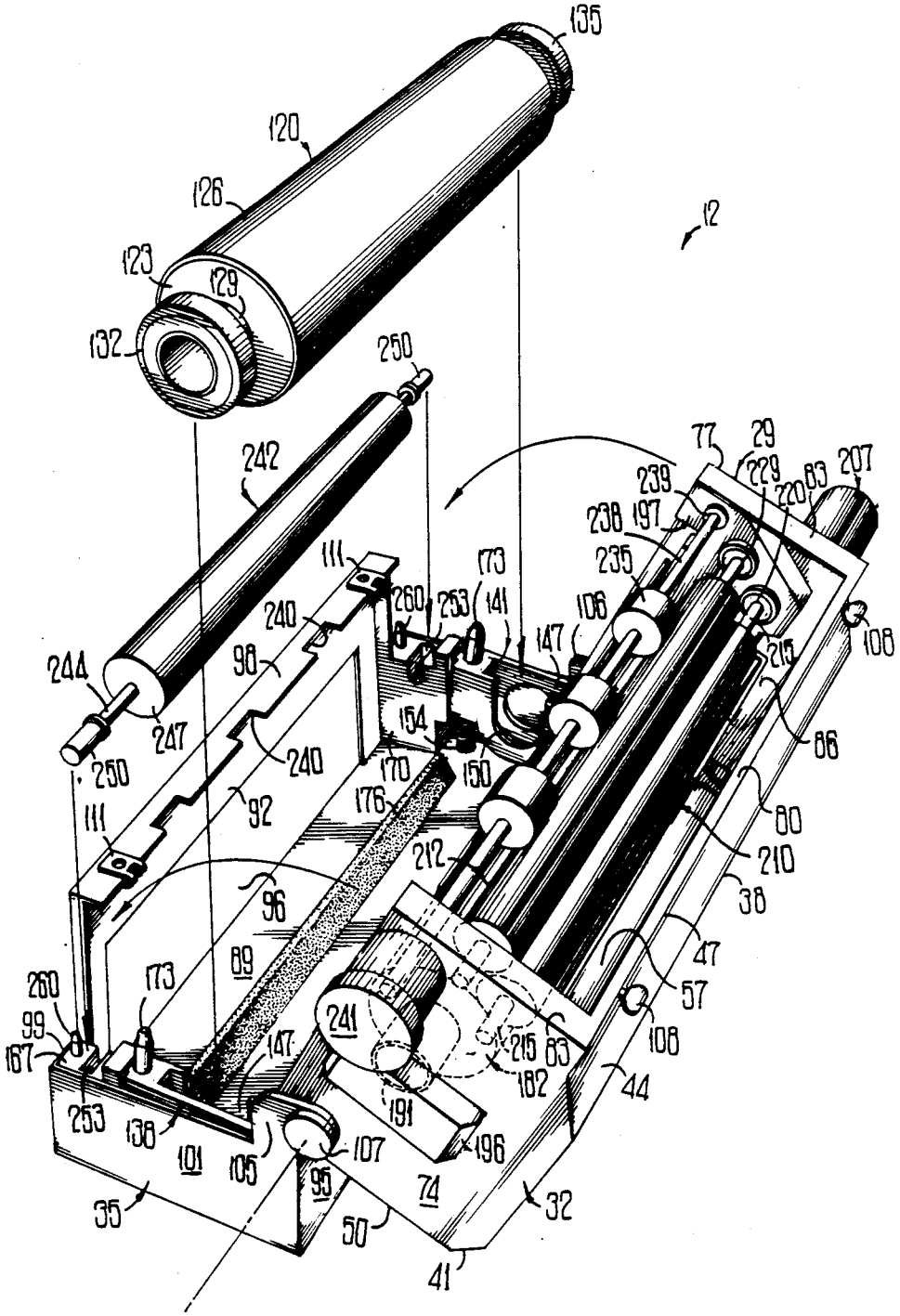
FIG. 2 is a partially exploded perspective view of a fuser apparatus according to a preferred embodiment.
Figure 3:
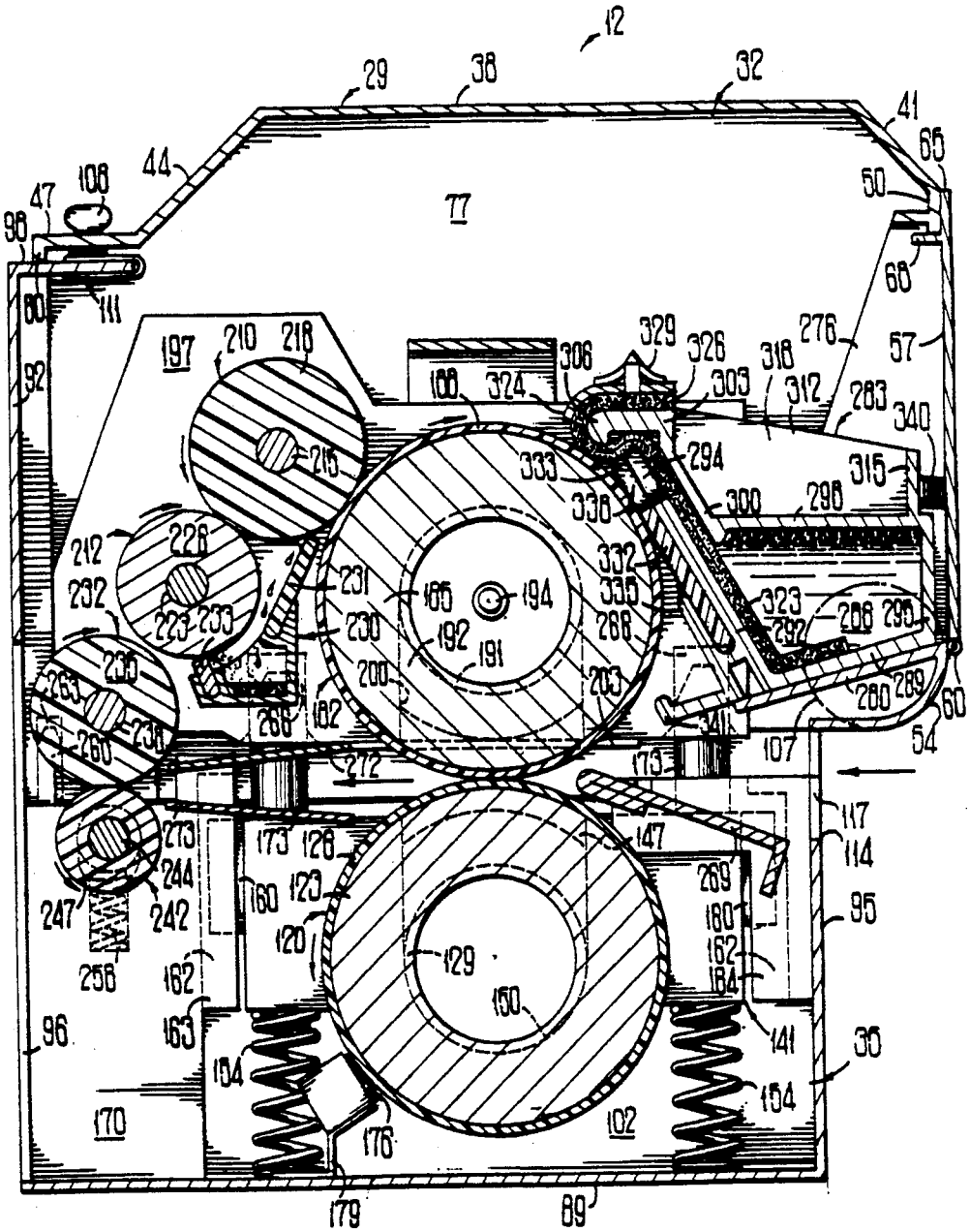
FIG. 3 is a side elevation view of the fuser apparatus shown in FIG. 2.
Figure 4:
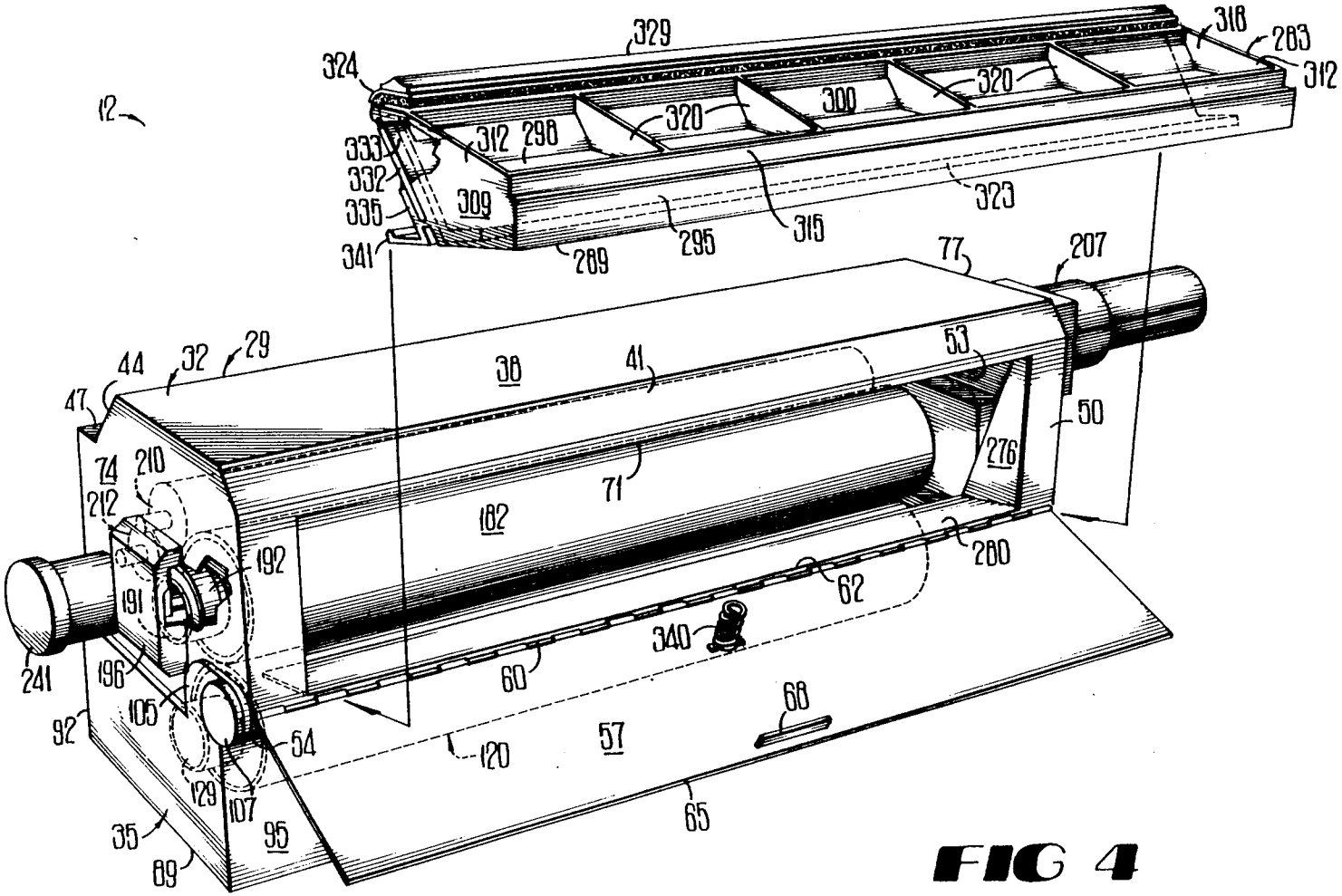
FIG. 4 is a partially exploded perspective view of the fuser apparatus shown in FIG. 3, illustrating the oil wick subassembly.

The fuser 12 as shown in FIGS. 2 and 3 includes a fuser housing 29 which generally comprises an upper frame 32 and a lower frame 35. The upper frame 32 of the fuser housing 29 includes a flat rectangular top plate 38. Edge plates 41 and 44 slope downwardly and outwardly from opposite longitudinal edges of the top plate 38. A narrow longitudinal plate 47 extends outwardly from the lower end of the sloped edge 44. As shown in FIG. 4, a rear plate 50 having a rectangular central opening 53 extends downwardly from the lower end of sloped edge plate 41. The lower edge 54 of rear plate 50 curves inwardly from the bottom edge of the rectangular opening 53 to the lower frame 35 of the fuser housing 29.

A rectangular rear cover panel 57 is mounted to the rear plate 50 with a hinge 60 just below the lower edge 62 of the rectangular opening 53 in the rear plate, so that the cover panel can rotate relative to the rear plate. The rectangular opening 53 in the rear plate 50 can then be covered by rotating the cover panel 57 about the hinge 60 towards the rear plate until the top edge 65 of the cover panel rests against the top edge of the rear plate. Likewise, the rectangular opening 53 can be exposed by pulling the top edge 65 of the cover plate 57 away from the rear plate 50. A narrow rib 68 protruding inwardly from the cover panel 57 is positioned near the top edge 65 of the cover panel so as to fit snugly against the upper edge 71 of the rectangular opening 53 in the rear plate 50, thereby holding the cover panel against the rear plate when the rectangular opening is covered. End plates 74 and 77 extend downwardly from the opposite ends of the top plate 38. A narrow rectangular front strip 80 (FIGS. 2 and 3) extends below the outer edge of the longitudinal plate 47 between the end plates 74 and 77. The rectangular front strip 80 and the narrow rectangular plates 83 (FIG. 2) which extend inwardly from the front edges of end plates 74 and 77 frame a rectangular frontal opening 86 in the upper frame 32.

The lower frame 35 of the fuser housing 29 includes a rectangular flat bottom plate 89 and two vertical walls, the front wall 92 and the rear wall 95, which extend upwardly from opposite longitudinal edges of the bottom plate. The front wall 92, FIG. 2, has a rectangular central opening 96 and a narrow top ledge 98 which extends inwardly from the upper edge of the front wall. An upper portion of each end of the front wall 92 is stepped inwardly as shown at 99 such that the upper edge of the front wall is shorter than the lower edge. Narrow rectangular strips 100 extend downwardly from the narrow top ledge 98 to the respective steps 99 at each end of the front wall 92. End plates 101 and 102 joins the ends of the bottom plate 89 and walls 92 and 95, and give the lower frame 35 a trough-like appearance.

An arm 105 (see FIG. 2) extends upwardly and outwardly from a portion of the upper edge of end plate 101 adjacent the rear wall 95 of the lower frame 35. Another arm 106 extends in an identical fashion from the upper edge of end plate 102. Hinge pins 107 extend through each of the arms 105 and through holes in the lower portion of each end plate 74 and 77 of the upper frame 32 proximate the lower curved edge 54 of rear plate 50 so that the upper frame and the lower frame 35 can rotate relative to one another. This gives the fuser housing 29 a clam-shell like appearance and operation. The fuser housing 29 is closed by rotating the upper frame 32 towards the lower frame 35 in the counter-clockwise direction, as seen in FIG. 2, until the narrow front strip 80 of the upper frame rests against the top ledge 98 of the front wall 92, as seen in FIG. 3. Bolts 108 fit through holes at opposite ends of the narrow plate 47 of the upper frame 32 and into nuts 111 mounted to opposite ends of the top ledge 98 of the lower frame 35 so that the upper frame of the fuser housing 29 can be firmly secured to the lower frame. The fuser housing 29 can likewise be opened by unfastening the bolts 108 and applying an upward force to the narrow plate 47 of the upper frame so as to rotate the upper frame in the clockwise direction, as seen in FIG. 2, away from the lower frame 35.

A rectangular notch in the upper edge 114 of the rear wall plate 95 of the lower frame 35 and the lower edge 54 of the rear plate 50 of the upper frame define a narrow rectangular opening 117 in the fuser housing 29 as indicated in FIG. 3.

As shown in FIG. 2, a longitudinal pressure roller 120 extends between end plates 101 and 102 within the lower frame 35 of the fuser housing 29. The pressure roller 120 includes a pressure roller cylinder 123 within cylindrical outer sleeve 126. A thin inner cylinder 129 is fixed within the pressure roller cylinder 123 extending outwardly from each end of the pressure roller 120. Bearing wheels 132 and 135 are mounted about each end of the inner cylinder 129 so that a longitudinal gap remains between each bearing wheel 132 and 135 and the respective ends of the pressure roller 120.

The bearing wheels 132 and 135 at each end of the pressure roller 120 rest in pressure roller mounts 138 and 141 located at opposite ends of the lower frame 35 of the fuser housing 29, adjacent the end plates 101 and 102 of lower frame. Each pressure roller mount comprises a block 143 with a centrally located U-shaped cavity 147. Each pressure roller mount 138 and 141 is positioned within the lower frame 35 so that the rounded portion of the U-shaped cavity faces upwardly. A corresponding but smaller U-shaped opening 150 in the inner-most face of each pressure roller mount 138 and 141 receives the inner cylinder 129 of the pressure roller 120 as the wheels 132 and 135 at each end of the pressure roller fit integrally within the U-shaped cavities 147 of the respective pressure roller mounts. Springs 154 extending from the bottom plate 89 of the lower frame 35 to pegs 157 (FIG. 3) protruding from the bottom of each end of the pressure roller mounts 138 and 141 support the pressure roller mounts and provide a positive force to the pressure roller 120 in the upper direction. Rectangular bars 160 extend from opposite ends of each pressure roller mount 138 and 141 toward the respective vertical walls 92 and 95 of the lower frame 35 and fit into adjacent rectangular slide channels 162 (shown in hidden lines in FIG. 3) in guide blocks 163 and 164. Two guide blocks 164 are fixed to the rear vertical plate 95 of the lower frame 35 of the fuser housing, one at each end of the rear vertical plate, and extend toward the respective pressure roller mounts 138 and 141. Two other guide blocks 163 protrude from the guide roller mounts 167 and 170, at each end of the front vertical plate 92, toward the pressure roller mounts 138 and 141. The guide roller mounts (described further below) are each fixed to the opposite corners formed by the end plates 101 and 102 and the steps 99 of the front wall 92. Each of the slide channels 162 is closed at the top end to hold the spring-loaded pressure roller mounts 138 and 141 within the lower frame 35 of the fuser housing 29. The pressure roller mounts 138 and 141 also include rounded pins 173 with tapered tips extending upwardly from the top of the pressure roller mounts on opposite sides of the U-shaped cavity 147.

A rectangular cleaning pad 176 is fixed to a V-shaped mount 179 which slopes upwardly from the bottom plate 89 of the lower frame 35 toward the pressure roller 120 so that the upper edge of the cleaning pad contacts the outer sleeve 126 of the pressure roller. The cleaning strip 176 contacts the lower portion of the pressure roller 120 facing the rectangular opening 96 in the front vertical plate 92 and runs along the length of the pressure roller. The cleaning strip 176 preferably comprises a soft fabric such as felt.

A fixing roller 182 extends between the end plates 74 and 77 of the upper frame 32 of the fuser housing 29 so that the fixing roller is parallel to the pressure roller 120 when the fuser housing is closed. The fixing roller 182 includes a fixing roller cylinder 185 (FIG. 3) within an outer sleeve 188 which contacts the outer sleeve 126 of the pressure roller 120 when the fuser housing 29 is closed. A thin inner cylinder 191 is fixed within the fixing roller cylinder 185 and extends beyond each end of the fixing roller 185. Bearing wheels 192 (partially shown in hidden lines in FIGS. 3 and 4) identical to the bearing wheels 132 and 135 fixed to the pressure roller 120 are likewise fixed to the inner cylinder 191 beyond each end of the fixing roller 182.

An inner heating element 194 fits within the inner cylinder 191. The heating element 194 is preferably a heater lamp, as is known to those skilled in the art. A block 196 removably secured to the end plate 74 of the upper frame 32 covers an access opening (not shown) through which the heating element 194 can be removed and replaced.

Roller support blocks 197 extend inwardly from each end plate 74 and 77 of the upper frame 32 of the fuser housing 29 toward the fixing roller 182. Inverted U-shaped slots 200 (shown in hidden lines in FIG. 3) in the roller support blocks 197 receive the bearing wheels 192 at each end of the inner cylinder of the fixing roller. Metal strips 203 (shown in FIG. 3) mounted to the bottom of the roller support blocks cover the lower portion of the inverted U-shaped slots 200 and hold the bearing wheels 192 of the fixing roller within the U-shaped slots. The inner cylinder 191 of the fixing roller 182 extends through an opening in the roller support block 197 and the adjacent end plate 77 of the fuser housing upper frame 32 to a system of gears and shafts 207 (partially shown in FIGS. 2 and 4) to which the inner cylinder is connected. A motor (not shown) drives the gear and shaft system which in turn rotates the fixing roller 182.

The pressure roller cylinder 123 and the fixing roller cylinder 185 preferably comprise a light metal such as aluminum. The outer sleeve 126 of the pressure roller 120 and the outer sleeve 188 of the fixing roller 182 preferably comprises a hard rubber material with a durometer hardness of 40 to 70 or more, preferably silicon rubber. As will be discussed further below, it is particularly advantageous that the outer sleeves 126 and 188 of the pressure roller 123 and the fixing roller 185 comprise the same material and that the pressure roller cylinder 123 and the fixing roller cylinder 185 comprise the same material.

Two cleaning rollers, a primary roller 210 and a secondary cleaning roller 212, are located next to the upper portion of the fixing roller 182 between the fixing roller and the front wall 92 of the lower frame 35 of the fuser housing 29. The cleaning rollers 210 and 212 extend longitudinally between end plates 74 and 77 of the upper frame 32. The primary cleaning roller 210 comprises a central rod 215 within an outer cylinder 218. The primary cleaning roller 210 is positioned within the fuser housing 29 so that the outer surface of the primary cleaning roller contacts the outer sleeve 188 of the fixing roller 182. Central rod 215 of the primary cleaning roller 210 extends beyond each end of the outer cylinder 218 of the primary cleaning roller and fits into holes 220 in each roller support block 197 such that the primary cleaning roller remains free to rotate. The secondary cleaning roller 212 also comprises a central rod 223 within an outer cylinder 226 and extends between the end plates 74 and 77 of the upper frame 32 of the fuser housing 29. The secondary cleaning roller 212 is located below the primary cleaning roller 210 such that the outer surface of the secondary cleaning roller contacts the outer surface of the primary cleaning roller but is distal from the outer sleeve of the fixing roller. The central rod 223 of the secondary cleaning roller 212 extends beyond each end of the outer cylinder 226 of the secondary cleaning roller and fits into holes 229 in each roller support block 197 such that the secondary cleaning roller remains free to rotate.

The outer cylinder 218 of the primary cleaning roller 210 preferably comprises a rubber material such as silicon rubber and the outer cylinder 226 of the secondary cleaning roller 212 preferably comprises a metal such as aluminum or steel.

A catch trough 230 is positioned beneath and extends the length of the primary and secondary cleaning rollers 210 and 212. A cleaning blade 231 extends diagonally and upwardly from an upper edge of the catch trough 230 to the lower portion of the outer cylinder 218 of the primary cleaning roller 210 between the fixing roller and the secondary cleaning roller 212. A second cleaning blade 233 extends from the other upper edge of the catch trough 230 to the outer cylinder 226 of the secondary cleaning roller 212.

An upper exit roller 232 is positioned below the secondary cleaning roller 212 and extends between the end plate 74 and 77 of the upper frame 32 of the fuser housing 29. The upper exit roller 232 is positioned in the upper frame 32 so that the upper exit roller is proximate the rectangular opening 96 in the front wall 92 when the fuser housing 29 is closed. The upper exit roller 232 comprises three short cylinders 235, FIG. 2, positioned equidistant from one another along a central rod 238. The ends of the central rod 238 of the upper exit roller 232 fit into holes 239 in the roller support blocks 197 such that the upper exit roller is free to rotate. One end of the central rod 238 of the upper exit roller 232 extends through the end plate 77 of the upper frame 32 to a system of gears and shafts (not shown). A motor (not shown) drives the system of gears and shafts which in turn rotates the upper exit roller 232. Rectangular notches 240 in the top ledge 98 of the front wall 92 of the lower frame 35 provide clearance for the three short cylinders 235 when the fuser housing 29 is closed. One end of the central rod 238 of the upper exit roller 232 extends through end plate 74 and connects to a cylindrical knob 241. The cylindrical knob 241 allows manual rotation of the upper exit roller 232.

A lower exit roller 242 is positioned proximate the rectangular opening 96 in the front wall 92 of the lower frame 35 below the upper exit roller 232 and extends between end plates 101 and 102 of the lower frame. The lower exit roller 242 is positioned in the lower frame 35 so as to contact the outer surface of the upper exit roller 232 when the fuser housing is closed. The lower exit roller 242 comprises a central rod 244 within an an outer cylinder 247. The central rod 244 extends from each end of the outer cylinder to enlarged rounded ends 250. The rounded ends 250 of the lower exit roller 242 rest in the lower exit roller mounts 167 and 170 in the lower frame 35. The lower exit roller mounts 167 and 170 each comprise a block with a U-shaped channel 253 cut downwardly into the block from the top of the block. The rounded ends 250 of the lower exit roller 242 fit in the U-shaped channels 253 in the lower exit roller mounts 167 and 170. Springs 256 positioned at the bottom of the U-shaped channels 253 of the lower exit roller mounts 167 and 170 provide an upward force to the lower exit roller 242. Round tapered pins 260 extend upwardly from the top of the lower exit roller mounts 167 and 170 and fit into corresponding round holes 263 (shown in hidden lines in FIG. 3) in the bottom of the roller support blocks 197 in the upper frame 32 of the fuser housing 29 when the fuser housing is closed. In this same manner, the rounded pins 173 protruding from the pressure roller mounts 139 and 141 fit into holes 266 (shown in hidden lines in FIG. 3) in the bottom of the roller support blocks 197.

The outer cylinders 235 and 247 of both the upper and lower guide rollers preferably comprise a hard rubber material such as rubber.

A sloped longitudinal entrance guide 269, shown in FIG. 3, is positioned between the pressure roller 120 and the rear vertical plate 95 of the lower frame 35 and extends between the guide blocks 164 in the lower frame. The entrance guide 269 slopes upwardly from the lower edge of the narrow rectangular opening 117 above the rear vertical plate 95 of the lower frame 35 to a position proximate the entrance side of the nip between the pressure roller 120 and the fixing roller 182. The entrance guide 269 is mounted to each guide block 164 with a pin (not shown) so that the entrance guide can pivot.

A pair of converging image receptor guides 272 and 273 are shown positioned between the nip between the upper and lower exit roller 232 and 242 and the exit side of the nip between the pressure roller 120 and the fixing roller 182. The converging image receptor guides 272 and 273 extend along the lengths of the pressure roller 120 and the fixing roller 182 and the converge toward the exit rollers 232 and 242. The converging exit guides 272 and 273 are connected to one another at each end (not shown) and the exit guide 272 is fastened at each end to the bottom of the roller support blocks 197 in the upper frame 32 of the fuser housing 29.

Triangular panels 276 extending inwardly from opposite sides of the rectangular opening 53 in the rear panel 50, along with a downwardly sloping platform 280 which extends inwardly from the lower edge 62 of the rectangular opening in the rear plate, form a support for the oil wick subassembly 283 (FIGS. 3 and 4). The oil wick subassembly 283 fits through the rectangular opening 53 in the rear plate 50 of the upper frame 32 of the fuser housing 29 and rests on top of the downward sloping platform 280 and the upper portion of the fixing roller 182. The oil wick sub assembly 283 includes an oil tank 286 which extends the length of the fixing roller 182 and includes a sloped bottom plate 289 (see FIG. 3), an upwardly sloping wick support plate 292 which extends from the lower edge of the bottom plate toward the fixing roller, and a vertical plate 295 extending upwardly from the upper edge of the bottom plate. Struts 294 (only one of which is shown in FIG. 3) protrude upwardly from the top edge of the wick support plate 292. An upper finned plate 298 extends horizontally from the upper edge of the vertical plate 295 toward the wick support plate 292 to an upward sloping portion 300 of the upper plate forming a thin gap between that upward sloped portion of the upper plate and the wick support plate. A flat ridge 303 extends horizontally from the top of the upward sloped portion 300 of the upper plate 298 towards the upper portion of the fixing roller 182, terminating in a rounded edge 306. The rounded edge 306 runs parallel to the upper portion of the fixing roller 182 along the length of the fixing roller. End plates 309 (see FIG. 4) complete the oil tank 286 and extend above the upper plate 298 of the tank, forming vertical fins 312 at each end of the tank. A narrow vertical wall 315 extends along the rear edge of the tank upper plate 298 between the two vertical end fins 312, forming an upper tray 318 above the tank 286. Four additional vertical fins 320 extend upward from the tank upper plate 298 between the sloped portion 300 of the upper plate and the narrow vertical wall 315 of the upper tray 318 and are spaced equidistant from one another and from the end fins 312.

A thin oil wick 323 extends from along the bottom plate 289 within the tank 286, up the sloped wick support 292, through the gap between the wick support and the sloped portion 300 of the upper plate 298, over the struts 294 protruding above the top edge of the wick support and below the flat ridge 303, around the rounded end 306 of the ridge, and over the top of the ridge. The oil wick 323 extends the length of the outer sleeve 188 of the fixing roller 182 as shown in hidden lines in FIG. 4. A curved cover piece 324 lies on top of the upper portion of the wick and extends from the top end 326 of the wick 323 and over the portion of the wick adjacent the rounded end 306 of the flat ridge 303. A longitudinal clamp piece 329 runs along the top of the cover piece 324, and pins protruding downwardly from the clamp piece through the cover piece and the wick 323 into the top of the flat ridge 303 secure the wick to the ridge. A rectangular leveling blade 332 (see FIG. 3) is mounted to the inward facing side of the wick support 292 and is held in place by a narrow strip 335 extending from the lower portion of the wick support over the inward-facing side of the leveling blade. The upper portion of the leveling blade 332 extends above the narrow strip 335 to the upper edge of the wick support 292. The top end of the leveling blade 332 contacts the outer sleeve 188 of the fixing roller 182 tangentially along the length of the fixing roller. Ears 333 protrude upwardly from each end of the leveling blade 332 to the rounded end 306 of the flat ridge 303. The top edge of the leveling blade 332, the top edge of the wick support 292, and wick 323, and the outer sleeve 188 of the fixing roller 182 define a reservoir 338 in which oil collects and from which the oil returns to the wick, as will be discussed further below.

An L-shaped entrance guide 341 extends from the bottom of the narrow strip 335, slopes downwardly toward the nip between the pressure roller 120 and the fixing roller 182, and runs the length of the fixing roller.

A spring 340 fastened to the inner face of the rear cover panel 57 extends to the rear vertical plate 295 of the wick sub assembly 283 when the rear cover panel 57 is closed, thereby pressing the wick 323 and the leveling blade 332 against the outer sleeve 188 of the fixing roller 182. The spring 340 is positioned to contact the midpoint of the rear vertical plate 295 so that force exerted by the leveling blade 332 and wick 323 is uniform along the length of the fixing roller 182. The leveling blade 332 preferably comprises an elastomeric material such as rubber.

During operation of the print engine 10, the fuser housing 29 is closed (as in FIGS. 3 and 4) and the outer sleeve 188 of the fixing roller 182 contacts the upper portion of the outer sleeve 126 on the pressure roller 120. Springs 154 force the pressure roller 120 upward against the outer sleeve 188 of the fixing roller 182. A motor (not shown) through a series of gears and shafts 207 rotates the fixing roller 182 in the clockwise direction as seen in FIG. 3.

Because the fixing roller 182 and the pressure roller 120 are in contact, the friction between the fixing roller and the pressure roller causes the pressure roller to rotate in the counterclockwise direction as seen in FIG. 3. As the fixing roller 182 rotates, the oil flows from the tank 286 up the wick 323 to the outer sleeve 188 of the fixing roller, forming a film of oil on the outer sleeve of the fixing roller. As the outer sleeve 188 of the fixing roller 182 moves across the upper edge of the leveling blade 332, the leveling blade removes the excess oil from the outer sleeve of the fixing roller and provides a thin oil film with a uniform thickness on the outer sleeve of the fixing roller.

As the print engine 10 operates, image receptor sheets with images formed from toner particles enter the fuser housing 29 through the rectangular opening 117 located above the rear wall 95 of the lower frame 35. Entrance guides 269 and 341 assist the entering image receptor sheet in reaching the nip between the fixing roller 182 and the pressure roller 120. The toner image is on the top side of the image receptor sheet, thus the outer sleeve 188 of the fixing roller 102 contacts the toner particles as the image receptor sheet is drawn through the nip between the pressure roller 120 and the fixing roller. The heat from the heating element 194 located within the fixing roller 182 melts the toner particles as the image receptor sheet passes between the fixing roller and the pressure roller 120, thereby fusing the toner particles to the top surface of the image receptor sheet. The film of oil on the outer sleeve 188 of the fixing roller 182 reduces the amount of toner particles that adhere to the outer sleeve of the fixing roller. The converging exit guides 272 and 273 assist the image receptor sheet as the image receptor sheet passes from between the fixing roller 182 and the pressure roller 120 in reaching the exit rollers 232 and 242.

The outer cylinder 235 of the upper exit roller 232 contacts the outer cylinder 247 of the lower exit roller 242 when the fuser housing 29 is closed. A spring 256 forces the lower exit roller 242 upward against the upper exit roller 232. A motor (not shown) through a series of gears and shafts rotates the upper exit roller 232 in the clockwise direction as seen in FIG. 3. Because the upper exit roller 232 and the lower exit roller 242 are in contact, the upper exit roller forces the lower exit roller to rotate in the counterclockwise direction as shown in FIG. 3. The image receptor sheet is drawn through the nip between the upper exit roller 232 and the lower exit roller 242 and out of the fuser housing 29 through the rectangular opening 96 in the front wall 92 of the lower frame 35 and into the paper tray 20 shown in FIG. 1.

In the preferred embodiment of the present invention, the pressure roller cylinder 123 and the fixing roller cylinder 185 each comprise the same material. In addition, the outer sleeve 126 of the pressure roller 120 and the outer sleeve 188 of the fixing roller 182 both comprise the same material, preferably silicon rubber as mentioned above. As a result, the pressure roller 120 and the fixing roller 182 are of an equal hardness and are therefore mutually compressible. Accordingly, the image receptor as it passes through the nip between the pressure roller 120 and the fixing roller 182 is not compressed by one of the rollers into an arc. As a result, the image receptor sheet exits the nip between the pressure roller 120 and the fixing roller 182 in a substantially straight manner rather than following one of the outer sleeves 126 and 188 of either the pressure roller 120 or the fixing roller 182 away from the converging exit guide 273. Therefore, paper fingers are not required to pull the image receptor from the pressure roller 120 or the fixing roller 182.

Figure 9:
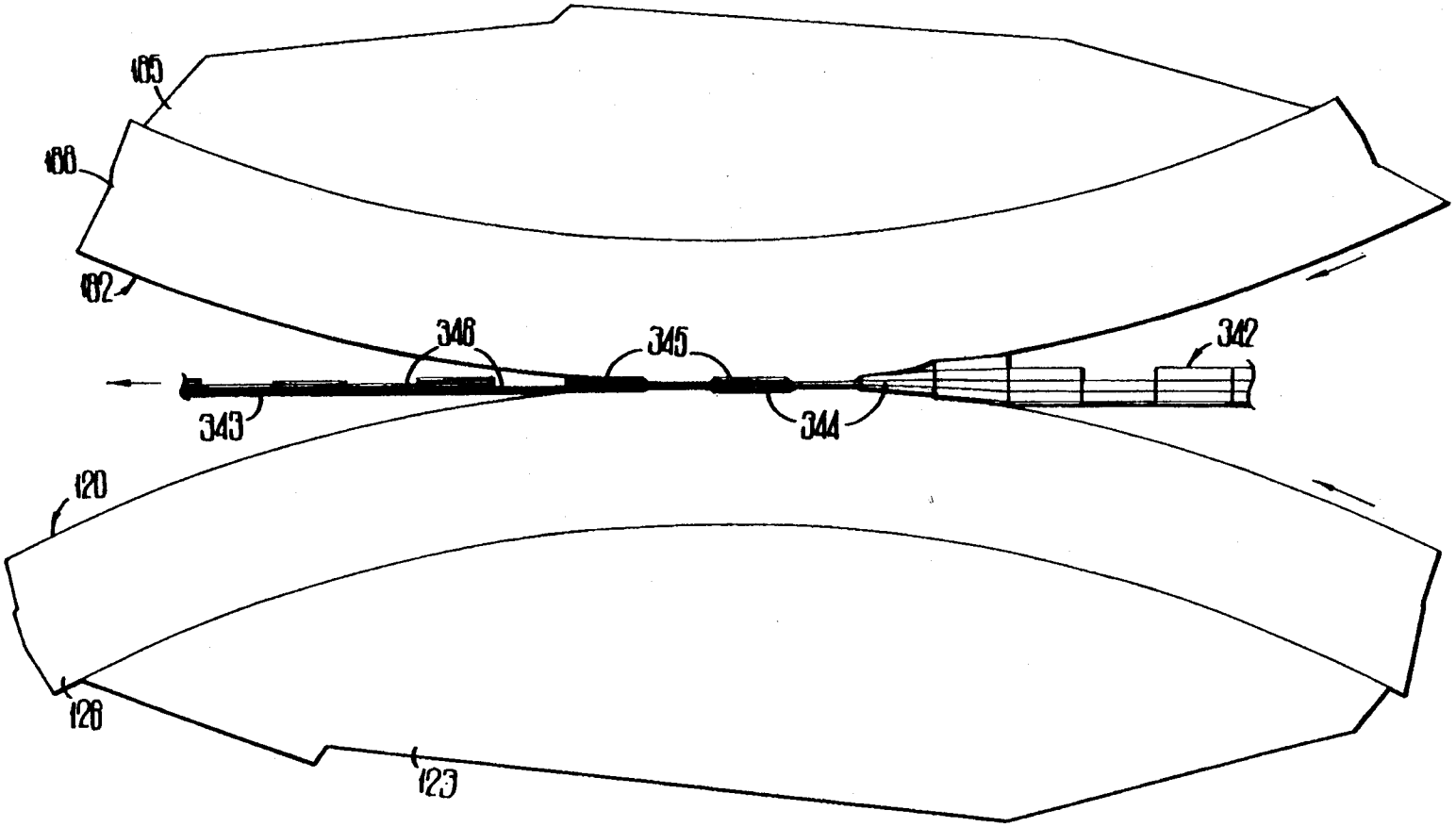
FIG. 9 is a partial side elevation view of a toner-laden image receptor passing through mutually compressible rollers.

In addition, the mutual compressibility of the fixing roller 182 and the pressure roller 120 is particularly advantageous when fusing multi-color toner images. As shown in FIG. 9, a multi-color toner image 342 is formed by the formation of successive mono-color toner images superimposed one image upon the other on top of an image receptor sheet 343. The combined mono-color toner images form the multi-color toner image 342. Normally, the superimposed mono-color toner images form irregular stacks 344 of one, two, three and four layers of toner. These irregular stacks 344 form a series of hills 345 and valleys 346 on the surface of the image receptor sheet 343.

When an image receptor sheet 343 with the multi-color toner image 342 passes through the nip between the fixing roller 182 and the pressure roller 120, the mutually compressible soft rubber outer sleeves 188 and 126 of the fixing roller and pressure roller conform to the irregular surface of the image receptor sheet caused by the multi-layered toner image. Because the outer sleeves 182 and 126 of the fixing roller 182 and the pressure roller 120 are mutually compressive, the outer sleeve of the fixing roller and the outer sleeve of the pressure roller each depress the stacks 344 of toner a substantially equal amount. The outer sleeve 182 of the fixing roller 188 presses into the valleys 346 in the multi-color toner image 342 and the outer sleeved 126 of the pressure roller presses upward on the thinner stacks 344 of toner. Thus, the outer sleeves each converge on the thinner stacks of toner. Accordingly, the outer sleeves 182 and 126 make direct contact with and exert pressure and heat over substantially the entire surface of the toner-laden image receptor sheet 343. Consequently, substantially the entire toner image 342 is melted and fixed to the image receptor sheet 343 and the fused toner image shows improved clarity and a uniformly glossy finish.

As the outer sleeve 188 of the fixing roller 182 contacts the outer cylinder 218 of the primary cleaning roller 210, any particles of toner that have adhered to the outer sleeve 188 of the fixing roller 182 are pulled away from the outer sleeve of the fixing roller and adhere to the outer cylinder of the primary cleaning roller. Some oil is also picked up by the outer sleeve 188 of the fixing roller 182. The primary cleaning roller 210 is rotated in the counterclockwise direction as seen in FIG. 3 by the fixing roller 182 and carries the toner to the outer cylinder 226 of the secondary cleaning roller 212. The toner adheres to the outer cylinder 226 of the secondary cleaning roller 212. The cleaning blade 233 scrapes the toner on the outer cylinder 226 of the secondary cleaning roller 212 and the scraped toner falls into the catch trough 230.

The cleaning blade 231 scrapes the oil from the outer surface 218 of the primary cleaning roller 210 so that the outer surface is substantially oil free. Because the outer surface 218 of the primary cleaning roller 210 is then substantially dry and non-lubricated, the toner particles on the outer sleeve 188 of the fixing roller 182 are more likely to adhere to the outer surface of the primary cleaning roller.

The cleaning pad 176 contacting the outer sleeve 126 of the pressure roller 120 removes any toner that may have adhered to the outer sleeve of the pressure roller as the outer sleeve of the pressure roller moves across the top edge of the cleaning pad.

While the print engine 10 and fuser 12 are operating, the excess oil removed by the leveling blade 332 tends to accumulate in the reservoir 338 located above the upper edge of the leveling blade. The ears 333 at each end of the leveling blade 332 prevent the oil from flowing over the ends of the leveling blade and down through the fuser 12. As the oil accumulates, the oil contacts the wick 323 and then flows back up the wick 323 and returns to the outer sleeve 188 of the fixing roller 182. As a result, the excess oil is used and not wasted.

Oil also tends to accumulate in the reservoir 338 located above the upper edge of the leveling blade 332 when the print engine 10 and fuser 12 are not operating. As the oil wick 323 rests against the idle fixing roller 182, oil from the reservoir 286 continues to flow up the wick to the outer sleeve 188 of the fixing roller 182 and accumulate in the reservoir 338. The oil accumulates in the reservoir 338 until the reservoir is filled with oil. Because the reservoir 338 confines the accumulated oil, the flow of oil through the wick 323 stops when the reservoir becomes filled with oil. The reservoir 338 confines the accumulated oil until the fuser 12 begins operation and the oil is reapplied to the outer sleeve 188 of the fixing roller 182.

As best seen in FIG. 4, the oil wick subassembly 283 is easily removed for replacement by pulling the top edge 65 of the cover panel 57 so that it rotates downward, thereby exposing the wick subassembly. The wick subassembly 283 can then be grasped by any of the vertical fins 312 and 320 along the upper tray 318 of the subassembly and pulled outward from the fuser housing 29 through the rectangular opening 53 in the rear panel 57 of the upper frame 32. A new wick subassembly can then be inserted through the rectangular opening 53 until the bottom plate 289 of the subassembly rests on top of the subassembly platform 280 and the upper portion of the wick 323 and the top edge of the leveling blade 292 rest against the outer sleeve 188 of the fixing roller 182.

The interior of the fuser housing 29 is easily accessible for service and repair because of the clam-shell like operation of the fuser housing. The fuser housing 29 is opened by unfastening the bolts 108 in the upper frame 32 and rotating the upper frame up and away from the lower frame 35. Because the fixing roller 182 is mounted in the upper frame 32 and the pressure roller 120 is mounted in the lower frame 35, the pressure roller and the fixing roller are immediately exposed for inspection and replacement or repair. The upper and lower exit rollers 232 and 242 are also immediately accessible upon the opening of the fuser housing 29. A particularly advantageous aspect of the clam-shell operation of the fuser housing 29 is that image receptor sheets which become jammed between the pressure roller 120 and the fixing roller 182 or between the upper and lower exit rollers 232 and 242 can immediately be removed by opening the fuser housing.

Figure 5:
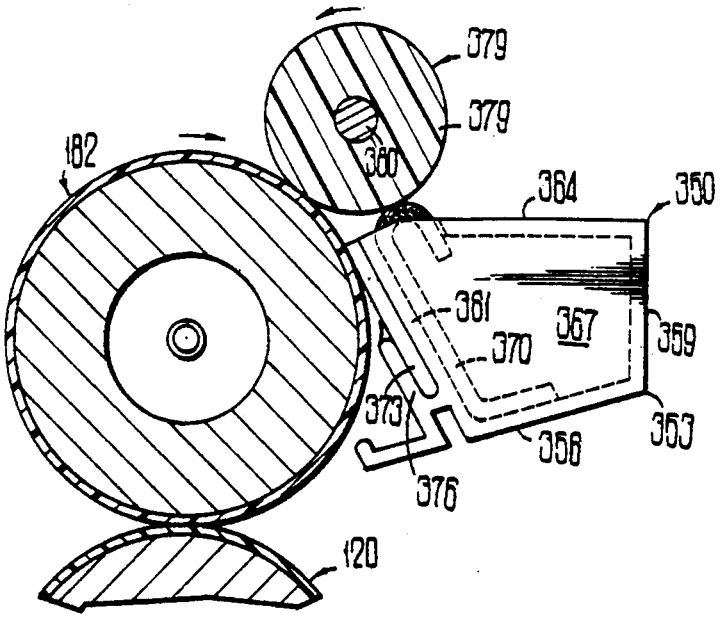
FIG. 5 is a partial side elevation view of another preferred embodiment of the present invention, illustrating an oil wick subassembly having an oiling roller.

Turning to FIG. 5, another preferred embodiment of the fuser 10 is shown with a modified oil wick subassembly 350. The oil wick subassembly 350 includes an oil tank 353. The oil tank 353 includes a sloped bottom plate 356, a vertical wall 359 which extends upwardly from the upper edge of the sloped bottom plate, and a sloped wick support plate 361 which extends from the lower edge of the bottom plate towards the fixing roller 182. A top plate 364 extends from the upper edge of the rear wall horizontally towards the fixing roller 182, forming a gap between the top edge of the support plate 361 and the front edge of the top plate. End plates 367 extending from the rear wall 359 to the support plate 361 to complete the oil tank 353.

An oil wick 370 extends from the bottom plate 356, up the support plate 361, and extends through the gap between the support plate and the top plate 364. A rectangular leveling blade 373 is mounted to the inward facing side of the support plate 361 and is held in place by a narrow strip 376 extending from the lower portion of the support plate over the inward-facing side of the leveling blade. The top end of the leveling blade 373 contacts the outer sleeve 188 of the fixing roller 182 tangentially along the length of the fixing roller. An oiling roller 379 is rotatably mounted above the leveling blade 373 and rests against the upper portion of the wick 370 and the outer sleeve 188 of the fixing roller 182. The oiling roller 379 includes an inner shaft 380 surrounded by an outer cylinder 381. The outer cylinder 381 of the oiling roller 379 preferably comprises rubber. The oiling roller 379 runs substantially the length of the fixing roller 182.

Figure 6:
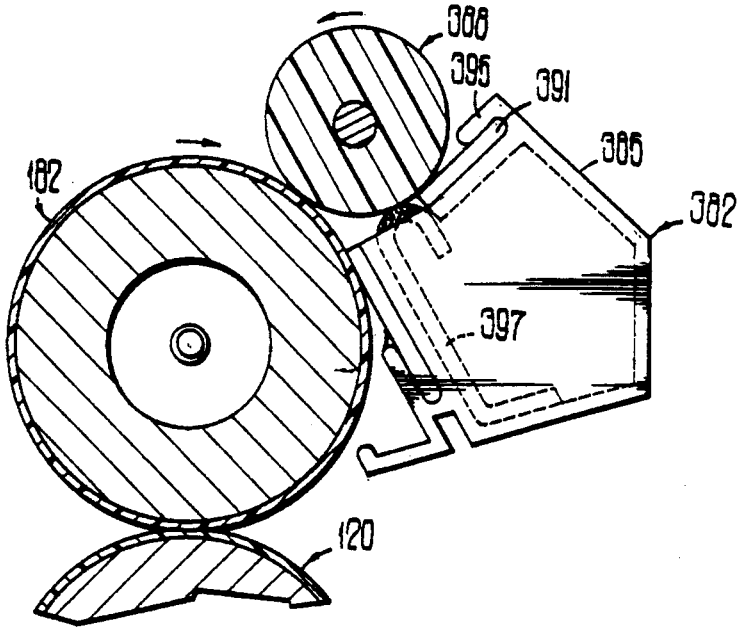
FIG. 6 is a partial side elevation view of another preferred embodiment of the present invention, illustrating an oil wick subassembly having an additional leveling blade.

In FIG. 6, another preferred embodiment of the fuser 10 is shown incorporating another modified oil wick subassembly 382. The oil wick subassembly 382 shown in FIG. 6 is identical to the oil wick subassembly 350 shown in FIG. 5 except that the top plate 364 in FIG. 5 is replaced by an inverted V-shaped leveling blade support 385 which extends upwardly from the rear plate 388 of the oil wick subassembly 382 in FIG. 6 and then downwardly towards the oiling roller 379. A leveling blade 391 rests on the downward sloping portion 394 of the leveling blade support 385 and is held in place by a narrow strip 395 extending from the peak of the V-shaped leveling blade support 385, over the upper portion of the leveling blade 391. The lower edge of the leveling blade 391 contacts the outer surface of the oiling roller 388 along the length of the oiling roller.

The oil wick subassemblies 353 in FIG. 5 and 382 in FIG. 6 are also removable and replaceable as is the oil wick subassembly 283 in FIG. 4.

The oil wick subassembly 350 in FIG. 5 operates similarly to the oil wick subassembly 283 in FIGS. 3 and 4 except that the oil wick 370 in FIG. 5 applies a film of oil to the oiling roller 379. The oiling roller 379, as it is rotated by the fixing roller 182, transfers the oil film onto the outer sleeve 188 of the fixing roller. The oil wick 397 in the oil wick subassembly 382 in FIG. 6 also applies oil to the oiling roller 388. However, a particular advantage of the oil wick subassembly 382 is that the leveling blade 391 gives the oil film applied to the oiling roller 388 by the wick 397 a substantially uniform thickness before the oiling roller transfers the oil film to the outer sleeve 188 of the fixing roller 182. As a result, the film of oil on the outer sleeve 188 of the fixing roller 182 is of a more uniform thickness.

Figure 7:
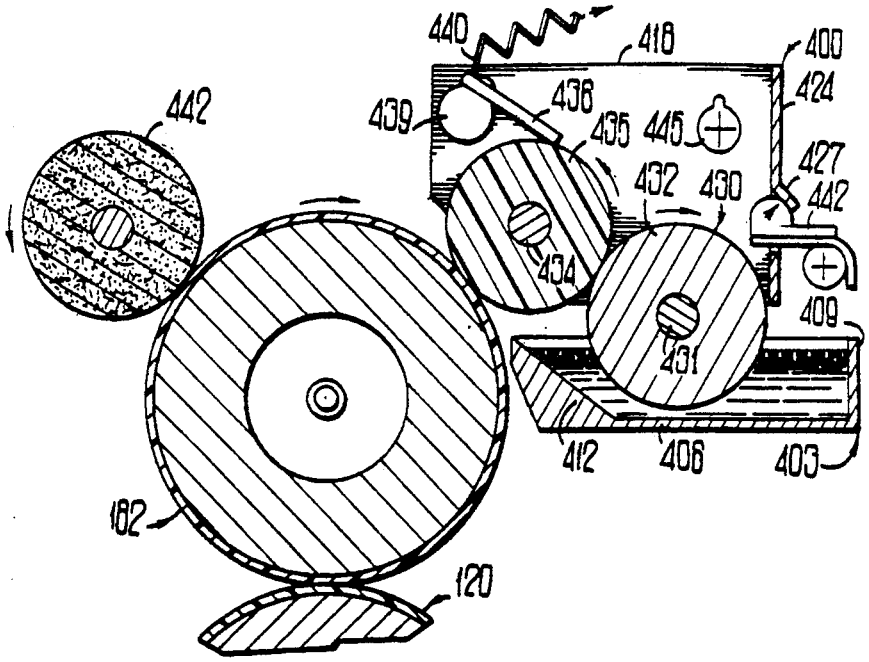
FIG. 7 is a partial side elevation view of another preferred embodiment of the present invention, illustrating a set of oil-applying rollers and a felt-covered cleaning roller.

Turning to FIG. 7, still another preferred embodiment of the fuser 10 is shown with an oiling station 400. The oiling station includes an oil tank 403. The oil tank 403 includes a flat bottom plate 406, a vertical rear plate 409 extending upwardly from the rear edge of the bottom plate 406, and a sloping front wall 412 extending from the front edge of the bottom plate 406 extends the fixing roller 182. End plates 415 extend from the ends of the rear wall 409 and the front wall 412 to give the oil tank 403 a trough-like appearance.

A roller bracket 418 is positioned above the oil tank 403 and includes end plates 421 connected by a rectangular rear plate 424. The end plates 421 extend below the lower edge of the rear plate 424. A sloped lever plate 427 slopes downwardly and outwardly from the lower edge of the rear plate 424.

An application roller 430 extends between the end plates 421 of the bracket 418, and the lower portion of the application roller 430 extends below the end plates 421. The application roller 430 includes a central shaft 431 surrounded by an outer cylinder 432. The central shaft 431 extends beyond each end of the outer cylinder 432 and is rotatably mounted to the end plates 421. An oiling roller 433 extends between the end plates 421 and contacts the outer surface of the application roller 430. The oiling roller 433 includes a central shaft 434 surrounded by an outer cylinder 435. The central shaft 434 extends beyond each end of the outer cylinder 435 and is rotatably mounted to the end plates 431. The oiling roller 433 extends beyond the front edges of the end plates 421 of the bracket 418. A rectangular leveling blade 436 extends between the end plates 421 of the bracket 418 and is positioned so as to tangentially contact the upper portion of the oiling roller 433. The leveling blade 436 is pivotally mounted in the end plates 421 at 439 and slopes downwardly towards the oiling roller 433 in the direction of the application roller 430.

The upper bracket 418 is constantly pulled in the direction away from the fixing roller 182 by means such as a spring 440. A solenoid-operated arm 442 operates to lower the bracket 418 towards the fixing roller 182 by forcing the lever plate 427 in the upward direction. The bracket 418 includes a pivot 445 above the application roller 430 about which the bracket rotates.

A felt cleaning roller 442 is rotatably mounted in the fuser housing 129 and is positioned contacting the outer sleeve 188 of the fixing roller 182.

When the bracket 418 is held downward towards the fixing roller 182, the application roller 430 is partially immersed in the oil tank 403 and the oiling roller 433

7. A fuser apparatus as in claim 6, further comprising:
first means for cleaning oil from the rubber roller so as to provide a substantially oil-free rubber roller, thereby enhancing the ability of the rubber roller to attract toner; and
means for receiving the oil cleaned from the rubber roller.

8. A fuser apparatus as in claim 7, further comprising:
second means for cleaning toner from the metallic roller; and
means for receiving the toner cleaned from the metallic roller.

9. An improved fuser apparatus for fusing toner to an image receptor sheet in an electrophotographic print engine, the improved fuser comprising:
means for fusing toner to an image receptor;
means for storing oil for application to the fusing means;
an oiling member having an outer surface, the oiling member located so that a portion of the oiling member contacts the fusing means;
means for applying a film of the stored oil to another portion of the oiling member;
means for moving the oiling member so that the oil film is transferred to the fusing means; and
a leveling blade contacting the outer surface of the oiling member so as to give the oil film a substantially uniform thickness before the oiling member transfers the oil film to the fusing means.

10. A fuser apparatus as in claim 9, wherein:
the oil applying means comprises a wick.

11. The fuser apparatus as in claim 10, wherein:
the oil applying means comprises a metallic application roller.

12. An improved fuser apparatus for fusing toner to an image receptor sheet in an electrophotographic print engine, the improved fuser apparatus comprising:
a fuser housing having a first frame, and having a second frame supported in predetermined relation below the first frame;
means normally mounting the first and second frames in closed relation and selectively displacing the frames apart one from the other;
the fixing member having an outer surface and disposed in one of the frames; and
the compression member having an outer surface and disposed in the other frame so that the outer surface of the fixing member and the outer surface of the compression member are in contact when the frames are in closed relation and are separated when the frames are displaced apart as to permit removing an image receptor sheet stuck between the members.

* * * * * contacts the outer sleeve 188 of the fixing roller 182. As the fixing roller 182, the oiling roller 433, and the application roller 430 rotate, the application roller carries oil from the oil tank 403 to the oiling roller 433.

A particularly advantageous aspect of the oil application station is the leveling blade 436. The leveling blade 436 gives the oil film on the oiling roller 433 a substantially uniform thickness before the oiling roller transfers the oil film to the fixing roller 182. The felt cleaning roller 442 operates to remove toner and oil that remain adhered to the outer sleeve 188 of the fixing roller 182.

Figure 8:
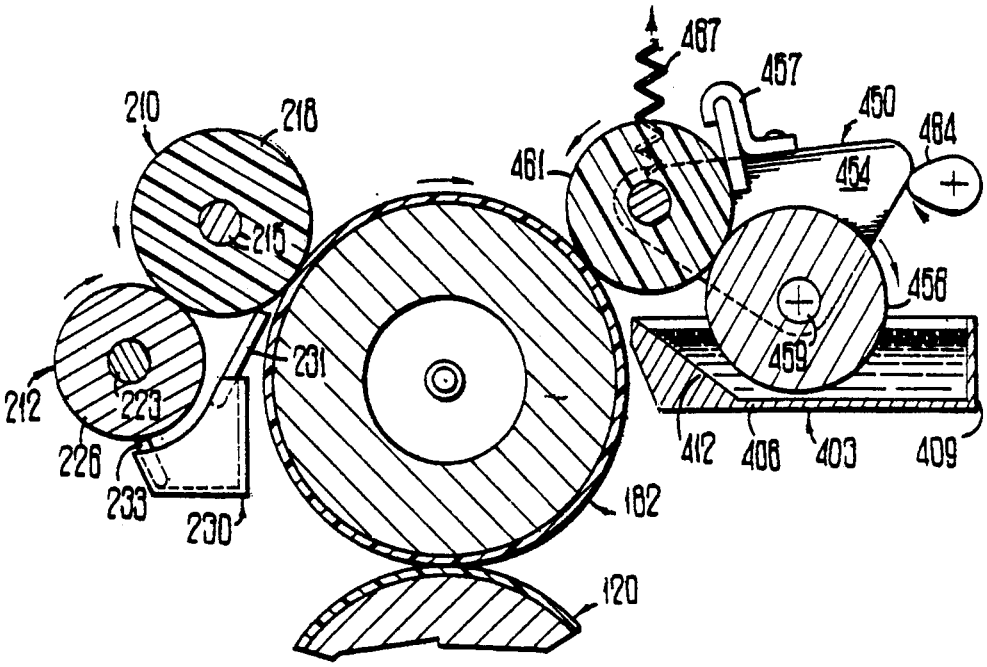
FIG. 8 is a partial side elevation view of still another preferred embodiment of the present invention, illustrating a set of oil-applying rollers in conjunction with cleaning rollers.

Another preferred embodiment of the fuser 10 is shown in FIG. 8 and includes an oil application station 450 identical to the oil application station 400 in FIG. 7 except that the roller bracket 453 comprises a pair of triangular end plates 454 connected by a leveling blade support 457. The roller bracket pivots about the application roller 456 at 459. This position of the pivot allows the oiling roller 461 to be lifted from the fixing roller by a solenoid arm 464 against the spring 467 independently of the application roller 456 and thus the oiling roller 461 is lifted with more ease. A leveling blade 470 is mounted to the leveling blade support 457 and extends downward to the oiling roller 461. The preferred embodiment shown in FIG. 8 also includes the identical cleaning rollers as shown in FIG. 3. The embodiment of the fuser apparatus shown in FIG. 8 combines the most preferred oil-applying means and the most preferred fixing roller cleaning means which minimizes wear on the outer sleeve 188 of the fixing roller 182 and thus provides for more uniform and thorough fusing of a toner image.

It should be understood that the foregoing relates only to a preferred embodiment of the present invention, and that numerous changes and modifications therein may be made without departing from the spirit and the scope of the invention as defined by the following claims.

We claim:

1. An improved fuser apparatus for fusing toner to an image receptor sheet in an electrophotographic print engine, the improved fuser apparatus comprising:

a fixing member having an outer surface;

a compression member having an outer surface contacting a portion of the outer surface of the fixing member;

means for moving the fixing member so as to draw a receptor sheet bearing toner between the fixing member and the compression member;

means for heating the fixing member so as to fuse toner to the image receptor sheet as the image receptor sheet is drawn between the fixing member and the compression member;

the outer surface of the fixing member and the outer surface of the compression member are substantially mutually compressible, so the image receptor sheet does not adhere to either the outer surface of the fixing member or the outer surface of the compression member as the image receptor passes between the fixing member and the compression member, and so the outer surface of the fixing member and the outer surface of the compression member conform to contours of the toner-laden image receptor sheet thereby providing a substantially uniform and thorough fusing of the toner to the image receptor sheet.

2. The fuser apparatus as in claim 1 wherein:

the outer surface of the fixing member and the outer surface of the compression member each comprise a material having a durometer hardness of between 40 to 70.

3. The fuser apparatus as in claim 1 wherein:

the outer surface of the fixing member and the outer surface of the compression member each comprise silicon rubber.

4. An improved fuser apparatus for fusing toner to an image receptor sheet in an electrophotographic print engine, the improved fuser apparatus comprising:

means for fusing toner to an image receptor sheet; and a subassembly comprising:

means for storing oil for application to the fusing means;

means for applying a film of oil to the fusing means so that the toner does not adhere to the fusing means; and means for removing excess oil from the fusing means so as to give the oil film on the fusing means a uniform thickness; and preventing oil from flowing on the fusing means while the fusing means is not operating;

so that the oil storage means, the oil applying means, and the oil removing means are simultaneously replaceable.

5. An improved fuser apparatus for fusing toner to an image receptor sheet in an electrophotographic print engine, the improved fuser apparatus comprising:

a fixing member having an outer surface;

a compression member having an outer surface contacting a portion of the outer surface of the fixing member;

means for moving the fixing member so as to draw a receptor sheet bearing toner between the fixing member and the compression member;

means for heating and fixing member so as to fuser toner to the image receptor sheet as the image receptor sheet is drawn between the fixing member and the compression member;

means for applying a film of oil to the outer surface of the fixing member so the toner on the image receptor sheet does not adhere to the fixing member; and a blade contacting the outer surface of the fixing member at a position below the oil applying means for removing excess oil from the outer surface of the fixing member before the outer surface of the fixing member contacts the image receptor sheet and after the film of oil has been applied, so as to give the oil film a substantially uniform thickness and prevent oil from flowing down the fixing member while the fuser apparatus is not operating, the blade contacting the outer surface of the fixing member tangentially, so that wear of the outer surface of the fixing member by the blade is reduced.

6. An improved fuser apparatus for fusing toner to an image receptor sheet in an electrophotographic print engine, the improved fuser apparatus comprising:

means for fusing toner to an image receptor sheet;

means for applying a film of oil to the fusing means so that the toner does not adhere to the fusing means;

a rubber roller for cleaning toner from the fusing means so the toner does not accumulate on the fusing means; and a metallic roller for cleaning toner from the first cleaning means.